United States Patent [19]

Maclin et al.

[11] 4,393,989

[45] Jul. 19, 1983

[54] ENVELOPE-TYPE MAILING FOLDER

[75] Inventors: Greg P. Maclin; Allen M. Brandenburger, both of Stone Mountain, Ga.

[73] Assignee: Container Corporation of America, Chicago, Ill.

[21] Appl. No.: 288,350

[22] Filed: Jul. 30, 1981

[51] Int. Cl.[3] ..... B65D 27/04; B65D 27/08; G09F 3/18

[52] U.S. Cl. ..... 229/71; 229/72; 40/10 D

[58] Field of Search ..... 229/71, 72, 73, 74, 229/75, 87.5, 56, 76; 40/10 R, 10 D

[56] References Cited

U.S. PATENT DOCUMENTS

| | | | |
|---|---|---|---|
| 41,828 | 3/1864 | Bristol | 229/75 |
| 622,598 | 4/1899 | Bragg | 229/72 |
| 1,110,286 | 9/1914 | Brown | 229/68 |
| 1,148,433 | 7/1915 | Benedict | 229/71 |
| 1,787,569 | 1/1931 | Deutschmeister | 229/82.5 X |
| 2,047,745 | 7/1936 | Poppe | 229/56 |
| 2,055,716 | 9/1936 | Berkowitz | 229/71 |
| 2,097,916 | 11/1937 | Elmore | 229/72 |
| 2,148,324 | 2/1939 | Sandon | 229/72 |
| 2,298,421 | 10/1942 | Salfisberg | 229/71 |
| 2,520,449 | 8/1950 | Allen | 229/71 |
| 2,921,731 | 1/1960 | Volchening et al. | 229/76 |
| 3,195,802 | 7/1965 | Jacobs | 229/72 |
| 3,321,127 | 5/1967 | Miller | 229/71 |
| 3,327,416 | 6/1967 | Sanford | 40/10 R |
| 3,420,432 | 1/1969 | Cooper | 229/71 |
| 3,446,421 | 5/1969 | Carrigan | 229/71 |
| 3,658,239 | 4/1972 | Foutz | 229/71 |
| 4,129,214 | 12/1978 | Gendron | 229/72 |

*Primary Examiner*—Steven M. Pollard
*Assistant Examiner*—Bryon Gehman
*Attorney, Agent, or Firm*—Richard W. Carpenter; Davis Chin

[57] ABSTRACT

An envelope type mailing folder having an inner primary pocket for receipt of the material to be shipped, and a transparent, outer secondary pocket for receipt of shipping documents.

1 Claim, 18 Drawing Figures

ENVELOPE-TYPE MAILING FOLDER

BACKGROUND OF THE INVENTION

1. Field of the Invention

This invention relates to mailing folders, and more particularly to an envelope-type mailing folder having a transparent outer pocket to receive a bill of lading or other type of document.

2. Description of the Prior Art

A prior art search directed to the subject matter of this application in the United States Patent and Trademark Office revealed the following U.S. Pat. Nos.: 1,148,433; 1,787,569; 2,097,916; 2,148,324; 2,298,421; 2,921,731; 3,327,316; 3,420,432; 3,446,421; 3,658,239; 4,129,214.

None of the prior art patents uncovered in the search disclosed a mailing folder of the type of the present invention having an internal pocket and separate transparent external pocket formed in the same manner as that of the present invention.

SUMMARY OF THE INVENTION

This invention relates to mailing folders and more particularly to envelope-type mailing folders formed of paperboard. The invention is particularly concerned with an envelope-type mailing folder having an internal pocket and having a large transparent external pocket adapted to receive a bill of lading, air bill or other type of receipt or document.

It is an object of the invention to provide a folder of this type which can be made out of an unitary blank of foldable sheet material such as paperboard.

A more specific object of the invention is to provide, in a folder of this type, a transparent outer pocket formed of plastic film which is large enough to accommodate a document as wide as the folder itself.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENTS

Figure 1:
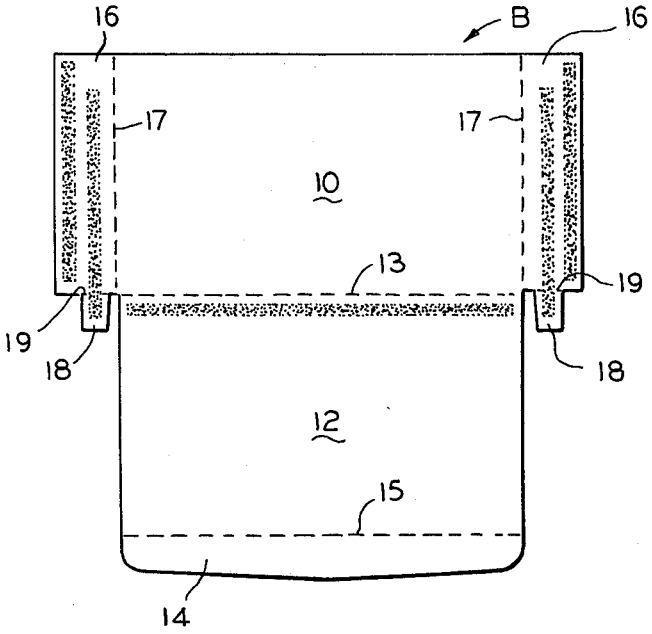
FIG. 1 is a plan view of the outer surface of a blank of foldable sheet material from which the mailing folder illustrated in certain of the other views may be formed.
Figure 8:
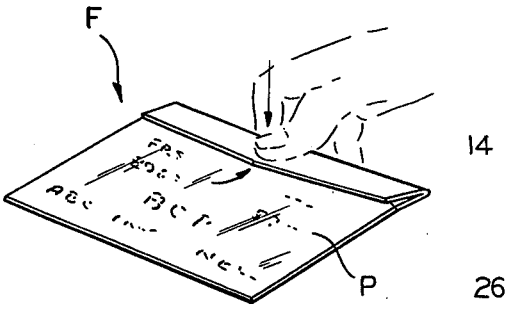
Figure 14:
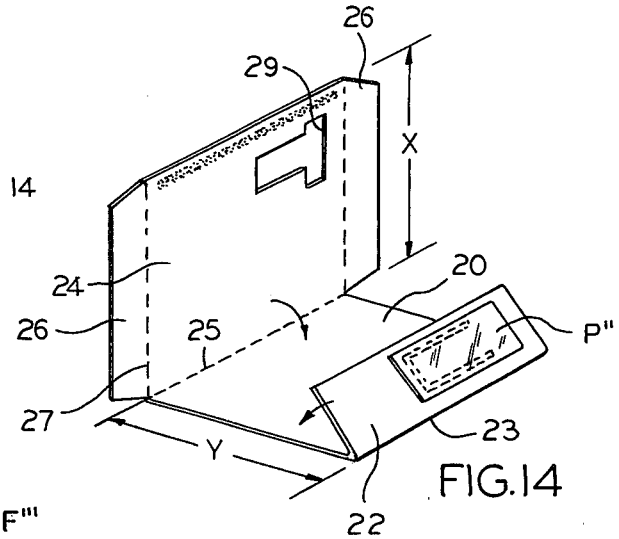
FIG. 14 is a perspective view of a blank used to form a slightly modified type of mailing folder, as seen in the partially closed position.

Referring now to the drawings for a better understanding of the invention, and particularly to FIGS. 1 through 8, it will be seen that the novel envelope-type mailing folder indicated generally at F in FIG. 8 may be formed from the unitary blank B of foldable paperboard illustrated in FIG. 1.

Figure 2:
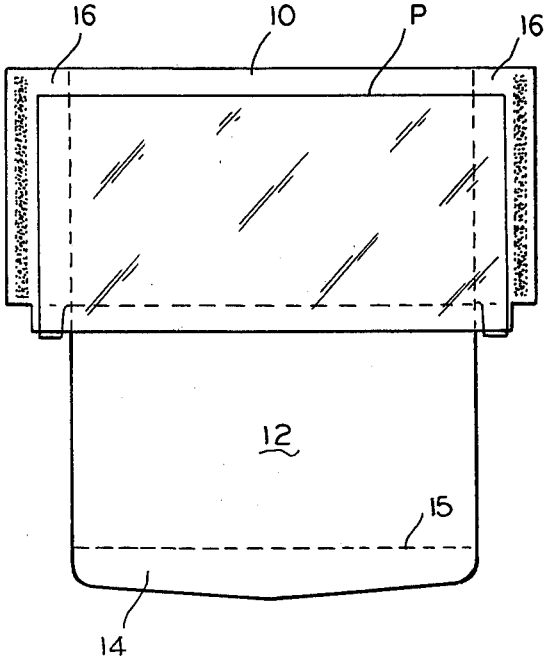
FIG. 2 is a view similar to FIG. 1, but with the transparent film shown attached to a portion of the outer surface of the structure of FIG. 1.
Figure 5:
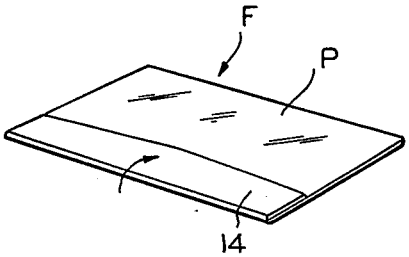
FIG. 5 is a view similar to FIG. 4, but with the closure flap folded 180° so as to overlie the rear panel.

Referring now to FIGS. 1 and 2 it will be seen that blank B of foldable paperboard from which the folder is formed includes a pair of major rear and front panels 10 and 12, respectively, which have adjacent side edges foldably joined to each other along a fold line 13. A closure flap 14 is is foldably joined along a fold line 15 to another side edge of front panel 12. A pair of end panels or flaps 16 are foldably joined to opposite ends of rear panel 10 along fold lines 17. Each of the end flaps 16 has a corner tab 18 foldably joined to one edge thereof on a fold line 19.

It will be understood that FIGS. 1 and 2 illustrate the outer surface of blank B. In order to provide a transparent pocket on the outer surface of the rear panel 10 of the folder, a generally rectangular sheet of transparent plastic film P is secured to rear panel 10, as shown in FIG. 2. It will be seen that portions of the sheet of plastic film cover the corner tabs 18 as well as a portion of the front panel 12.

Figure 3:
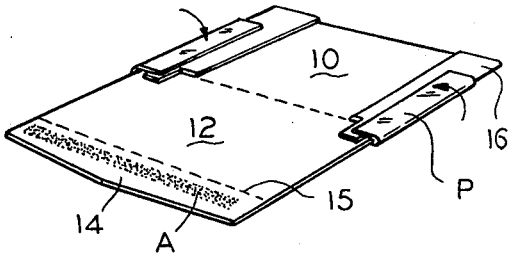
FIG. 3 is a perspective view of the inner surface structure illustrated in FIG. 2 but with the end flaps shown folded over at 180° from the position of FIG. 2.
Figure 4:
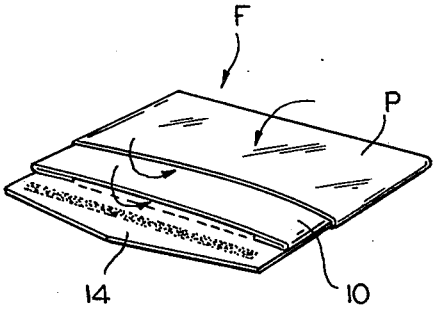
FIG. 4 is a view similar to FIG. 3, but with the rear panel and end flaps shown folded over 180° so as to overlie the front panel.

In order to form the blank into a folder the blank, as shown in FIG. 2, it is turned over, so that the inside surface of each of the panels is facing up. The end flaps 16 are then folded over 180°, as shown in FIG. 3, so as to overlie the inside surface of rear panel 10. Rear panel 10 is then folded over 180°, as shown in FIG. 4, so as to overlie and be adhesively secured to the inside surface of front panel 12. In this way the completed package is formed.

Figure 6:
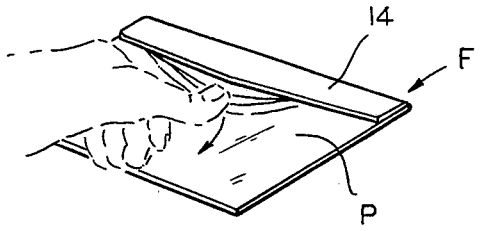
FIGS. 6, 7 and 8 are views similar to FIG. 5, but illustrate the manner in which a bill of lading or other document is inserted into the transparent pocket on the rear side of the mailing folder of the other views.
Figure 7:
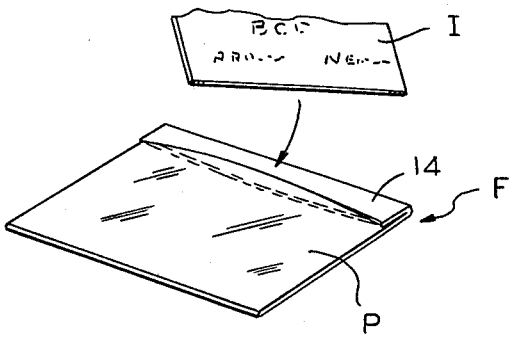

In order to use the package the material to be shipped is placed inside the inner pocket, formed between the front and rear panels, and the closure flap 14 is folded over the marginal portion of the rear surface of rear panel 10 and adhesively secured thereto. It will be appreciated that the plastic film, together with the rear panel 10, provides a large pocket to accommodate the receipt of a bill of lading or other shipping document which is inserted between the film and the rear panel. In order to take the document out of the pocket, portions of the pocket can be pulled down, as shown in FIG. 6. Thus, it will be appreciated that the novel folder provides a sealed inner pocket, for the basic material to be shipped, as well as a transparent outer pocket extending the entire length of the package for receipt of the shipping documents.

Figure 9:
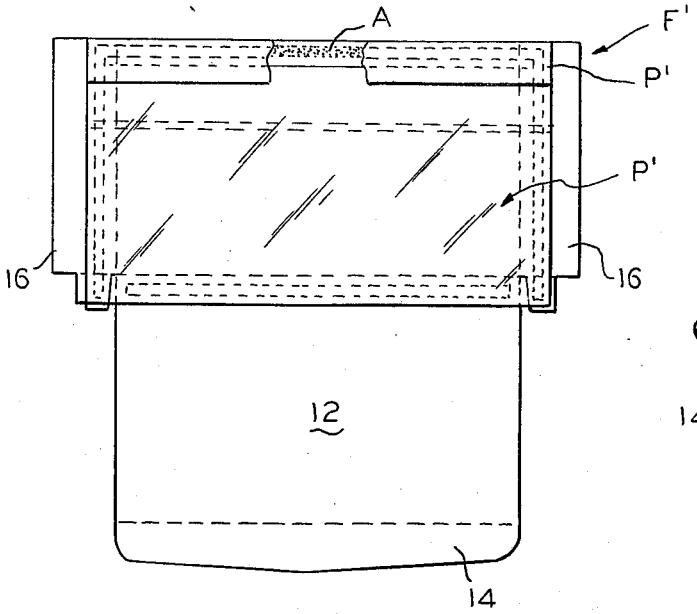
FIGS. 9, 10 and 11 are views similar to FIGS. 1, 3 and 6, respectively, but illustrate a modified form of the invention.
Figure 10:
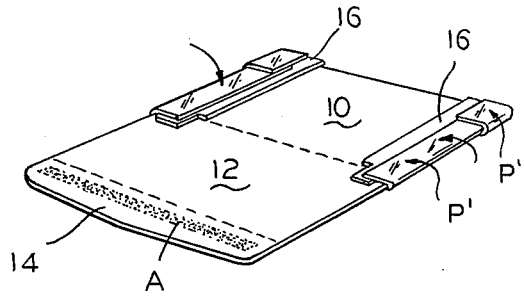
Figure 11:
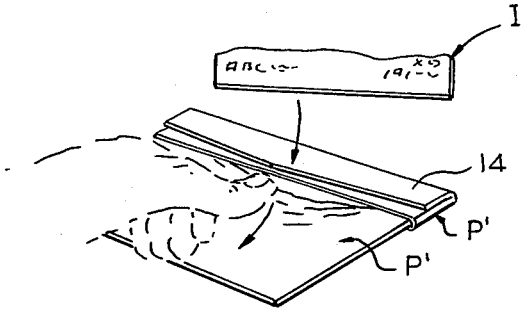

Referring now to FIGS. 9 through 11, it will be seen that a slightly modified form of the invention is shown. In this embodiment as in the case of other embodiments where structures correspond to structures of previously described embodiments they are indicated by the same or similar numerals or letters.

In this embodiment the paperboard structure of folder F′ is identical to that of the previously described embodiment; however, the plastic film P′ is in two pieces rather than one piece. The two pieces of the film P′ overlap each other to provide a means of access to the transparent pocket for receipt of the shipping documents, as shown in FIG. 11.

Figure 12:
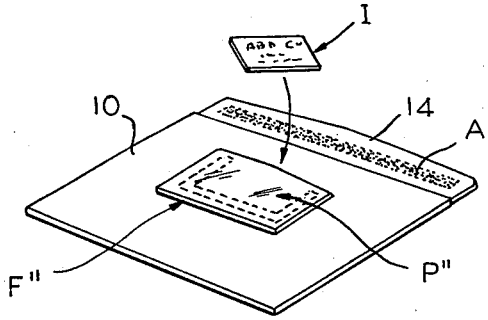
FIGS. 12 and 13 are views similar to FIGS. 4 and 5, respectively, but illustrate another modified form of the invention.
Figure 13:
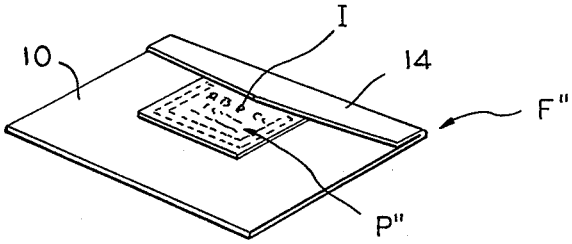

Referring now to FIGS. 12 and 13, it will be seen that yet another form of the invention is shown. Again in this embodiment the structure of the paperboard portion of the folder F″ is the same as that of the previous embodiments. In this embodiment, however, the plastic film P″ is much smaller than the panel to which it is attached. The plastic film is attached to the outer surface of the rear panel of the folder and again presents a separate transparent pocket for receipt of shipping documents.

Turning now to FIGS. 14 through 18, it will be seen that another but slightly modified form of the invention is shown. In this embodiment the folder F‴ includes a generally rectangular front panel 20 and a pair of overlapping inner and outer rear panels 22 and 24 which are foldably joined to opposite side edges of front panel 20 along fold lines 23 and 25, respectively. Outer rear panel 24 is of substantially the same dimension as front panel 20; whereas, inner rear panel 22 can be substantially narrower in width.

A pair of end flaps 26 are foldably joined on fold lines 27 to opposite ends of rear outer panel 24 and function in the same manner as closure flap 14 of the earlier described embodiment.

Figure 15:
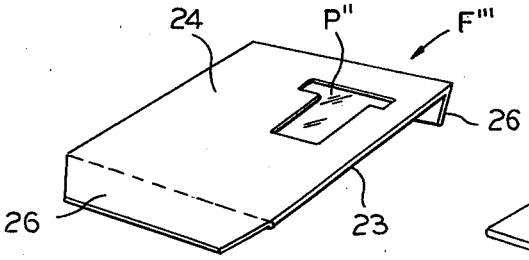
FIG. 15 is a view similar to FIG. 14 but showing another step in the closure of the folder.
Figure 16:
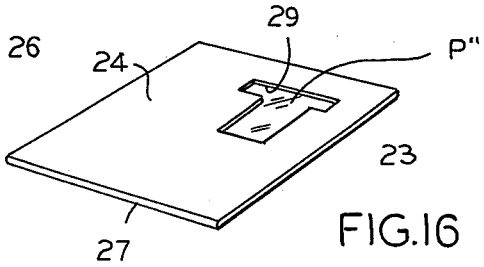
FIG. 16 is a view similar to FIG. 15 but shown with the folder completely closed.

In this embodiment the pocket for receipt of the bill of lading or other shipping document is formed by a sheet of plastic film P‴ which is adhesively secured along certain of its marginal portions to the outer surface of inner rear panel 22. At the same time outer rear panel 24 is provided with a T-shaped opening 29 which, when the inner and outer panels are folded into overlapped relation and secured together, overlies the plastic film P‴, as shown in FIGS. 15 and 16.

Figure 17:
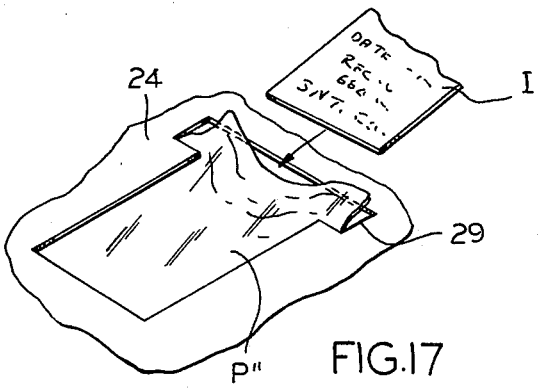
FIG. 17 is a fragmentary but enlarged view of a portion of the structure of FIG. 16 illustrating the manner in which a bill of lading or other document is inserted into the outer pocket of the folder.
Figure 18:
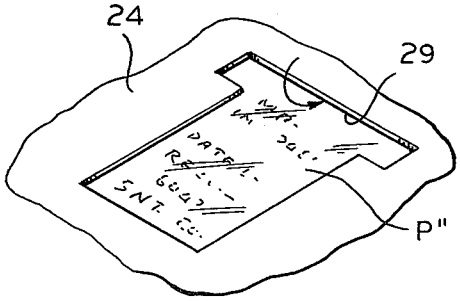
FIG. 18 is a view similar to FIG. 17 but showing the folder after the document has been inserted into the transparent pocket.

In order to insert the shipping document into the transparent pocket, the edge of the film is pulled down, as shown in FIG. 17, and the document is inserted.

Thus, it will be appreciated that each embodiment of the invention provides an envelope-type mailing folder with a secure inner pocket for receipt of the material to be shipped and a transparent outer pocket which is readily accessible for receiving and displaying a shipping document.

What is claimed is:

1. In an envelope-type mailing folder formed from a unitary blank of foldable paperboard, the combination of:

(a) a rear panel;

(b) a pair of end panels foldably joined to opposite ends of said rear panel and folded to overlie marginal end portions of said rear panel;

(c) a front panel foldably joined along one side edge to a side edge of said rear panel;

(d) said front panel overlying said rear panel and said end panels and being secured to the latter to form with both said rear panel and said end panels an internal, primary pocket for receiving material to be transported in said folder;

(e) a closure flap foldably joined to another side edge of said front panel and being folded to overlie and be secured to said rear panel to close said primary pocket;

(f) a transparent, plastic film having marginal areas secured to a portion of said front panel, said end panels and an outer surface of said rear panel extending the entire length thereof to form with said rear panel a separate, external secondary pocket for receiving and displaying other material, said plastic film including a pair of sheets having adjacent marginal areas disposed in overlapped relation to provide access to said secondary pocket.

* * * * *